US005275026A

United States Patent [19]

Chilcoat

[11] Patent Number: 5,275,026

[45] Date of Patent: Jan. 4, 1994

[54] CLOTHES WASHING MACHINE

[75] Inventor: Edward A. Chilcoat, Columbus, Ohio

[73] Assignee: Staber Industries, Inc., Groveport, Ohio

[21] Appl. No.: 997,106

[22] Filed: Dec. 24, 1992

Related U.S. Application Data

[63] Continuation of Ser. No. 818,523, Jan. 9, 1992, abandoned.

[51] Int. Cl.[5] ..... D06F 21/04

[52] U.S. Cl. ..... 68/58; 68/142; 366/220

[58] Field of Search ..... 366/220, 234, 236; 68/142, 24, 139, 58

[56] References Cited

U.S. PATENT DOCUMENTS

| | | | |
|---|---|---|---|
| 27,391 | 3/1860 | Smith | 68/58 |
| 119,089 | 9/1871 | Lea | 68/58 |
| 125,950 | 4/1872 | Goodloe | 68/142 |
| 197,158 | 11/1877 | Morehouse | 68/142 |
| 323,073 | 7/1885 | Postlethwaite | 68/142 |
| 482,684 | 9/1892 | Herder | 68/58 |
| 520,771 | 6/1894 | Edgar | 68/142 |
| 1,121,451 | 12/1914 | Baird et al. | 366/220 X |
| 1,157,121 | 10/1915 | Oppen | 68/142 |
| 2,867,107 | 1/1959 | Brown . | |
| 4,240,913 | 12/1980 | Burke . | |
| 4,484,461 | 11/1984 | Parks et al. . | |

FOREIGN PATENT DOCUMENTS

| | | | |
|---|---|---|---|
| 11231 | of 1884 | United Kingdom | 68/58 |

*Primary Examiner*—Frankie L. Stinson
*Attorney, Agent, or Firm*—Foster Frank H.

[57] ABSTRACT

A washing machine having an outer, stationary, liquid impervious container, having a plurality of adjacent, peripheral walls, preferably in the form of an octagon. An inner drum has perforate walls, is preferably in the form of a hexagon and is mounted within the outer container for rotation about a horizontal axis. The inner drum is driven in rotation, causing variations in the adjacent liquid volume between each drum wall and the outer container as the drum walls pass through the liquid. Because the wall is contoured to have a distance from the axis of rotation which varies as a function of peripheral, angular position to form a plurality of relatively protruding, liquid pushing perforate lobes, the movement of these lobes through the washing liquid causes an inflow of washing liquid into the drum through the leading perforate surface of each lobe and out of the drum through each trailing perforate surface.

4 Claims, 5 Drawing Sheets

CLOTHES WASHING MACHINE

This is a continuation of application No. 07/818,523, filed Jan. 9, 1992, now abandoned.

TECHNICAL FIELD

This invention relates generally to machines for washing articles in a washing liquid and cleaning compounds and more particularly relates to a clothes washing machine of the type which has an outer, liquid impervious container and an inner perforate drum for holding garments, the inner drum being driven by a motor in order to cause scrubbing and mechanical working of the clothes and mixing of the cleaning liquid.

BACKGROUND ART

The efficient cleaning of clothes requires that the cleaning agents, such as soap or detergent, commonly in a liquid mixture, be brought into contact with all areas of the garments in order to break the soil fiber bond. Cleaning also requires that some scrubbing or mechanical working of the garments occur in order to open up the weave and to mechanically rub or knock off the soil. It is further desirable that the washing action maintain liquid circulation and turbulence throughout all liquid-containing regions in order to mix the cleaning agents into the liquid and maintain a homogeneous mixture of the cleaning agents throughout the liquid.

The conventional, modern clothes washing machine has a central agitator which pivotally reciprocates about a vertical axis to accomplish mechanical working of the clothing and stirring of the cleaning liquid. However, agitator-type washing machines suffer from some disadvantages. Their vanes rub the clothing relatively harshly as a result of the rapid, periodic reversing of direction of the agitator. Also, cleaning compounds tend to collect in relatively high concentration in the region below the inner perforate drum and above the bottom of the outer, impervious container because there is relatively little turbulence in this relatively calm region and little circulation between this lower region and the main cleaning volume in the perforate drum.

Prior to the predominance of the modern agitator-type washing machines, front loading washing machines which rotated about a horizontal axis, were popular. These horizontal axis machines accomplished the mechanical working and scrubbing of the clothing by a tumbling action in which the garments are repetitively lifted by a combination of centrifugal force and vanes, which extend inwardly from the interior surface of the inner drum walls, and then dropped back into the cleaning liquid. Mechanical action of this type is more gentle and accomplishes more uniform cleaning because this repetitive lifting, rotating, and dropping of the garments tends to continuously move the clothing into various configurations as the operation progresses, rather than simply rolling the clothing and abrading the exterior of the roll.

The front loading machines, however, are relatively complicated because their rotating drum is cantilever supported at the back of the machine. In addition, the use of a front door requires a liquid seal which can easily leak upon deterioration of its gasket. For these reasons and the fact that the door cannot be opened to add additional clothing once the front loader is filled with liquid, the manufacture of such machines in the United States has essentially been discontinued. However, because of the more severe water shortage in Europe, front and top loading machines which rotate about a horizontal axis are common.

One advantage of horizontally rotating machines is that they inherently require less liquid and therefore additionally inherently require less soap. The reason is that horizontally rotating washing machines do not require full immersion of the entirety of the batch of clothing as is required by agitator machines because the horizontal rotating machine relies upon picking the clothes up from the liquid and dropping them back, rather than full immersion and toroidal circulation as in the agitator machines. Since the horizontal machines utilize considerably less water, they also require considerably less detergent to obtain the same detergent concentration.

It is an object and purpose of the present invention to obtain the advantages of a top loading machine, which rotates about a horizontal axis, while simultaneously further improving both the liquid and soap consumption efficiency and the cleaning effectiveness. This is accomplished in the present invention by creating additional fluid flow action within the cleaning liquid, which in turn produces additional mechanical working of the clothing and improved stirring and mixing of the cleaning liquid and any softening agents being used.

BRIEF DISCLOSURE OF INVENTION

The present invention creates additional hydraulic action within the cleaning liquid by inducing liquid motion into and out of the inner perforate drum, causing additional turbulence and mechanical action which serve not only to apply additional mechanical scrubbing forces to the garments, but also to initially mix cleaning and softening agents into the cleaning liquid and maintain the cleaning liquid thoroughly and homogeneously stirred in all regions within the outer liquid impervious container.

The present invention has an outer, relatively stationary, liquid impervious container for containing a washing liquid. The outer container includes a plurality of adjacent walls, intersecting and joining at interposed axes around at least the bottom portion of the outer container. Each wall is inclined to its adjoining walls. An inner drum having perforate walls is mounted within the outer container for rotation about an axis. The inner drum is formed with a plurality of adjacent walls facing the walls of the outer container and intersecting and joined at interposed axes. Each of the inner drum walls is also inclined to its adjoining wall. A drive means, such as an electric motor, rotates the inner drum about its axis of rotation. Preferably, the outer peripheral walls of the outer container are formed as a portion of a regular polygon and the peripheral walls of the rotating drum are formed as a regular polygon and the two polygons have a different number of sides.

By forming these walls in this manner, the adjacent liquid volume in the space between each wall of the rotating drum and the walls of the outer container varies as the drum walls pass through the liquid. This variation in interposed volume creates a hydraulic pumping action, causing the cleaning liquid to alternately move into and out of the drum in a cyclical manner through its perforations. In addition to the hydraulic pumping action, forming the walls in this manner also provides a plurality of protruding, liquid pushing, perforate lobes around the exterior of the rotating drum. Each of these lobes has a leading surface and a lagging surface. As the lobes pass through the cleaning liquid, a relatively higher pressure is exerted by the liquid against the outside of the leading perforate surface and a lower pressure occurs at the outside of the lagging perforate surface. The pressure differential causes an inflow of liquid through the leading surface into the drum and an outflow of liquid through the lagging surface. These two additional liquid flow actions cause additional working of the clothes and more thorough mixing of the cleaning liquid to cause increased cleaning effectiveness as well as further savings of liquid and cleaning compounds.

Figure 1:
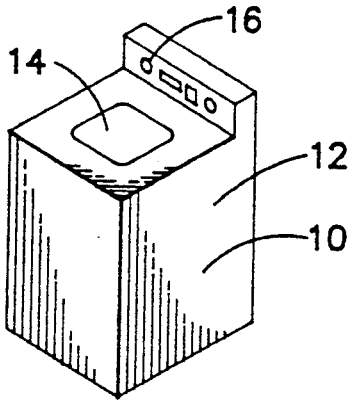
FIG. 1 is a view in perspective of a washing machine embodying the present invention.
Figure 2:
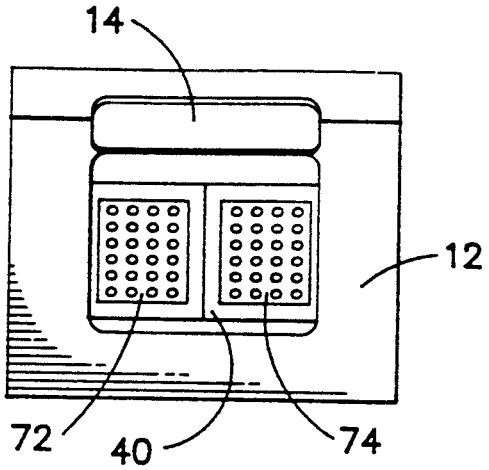
FIG. 2 is a top plan view of the washing machine illustrated in FIG. 1.
Figure 3:
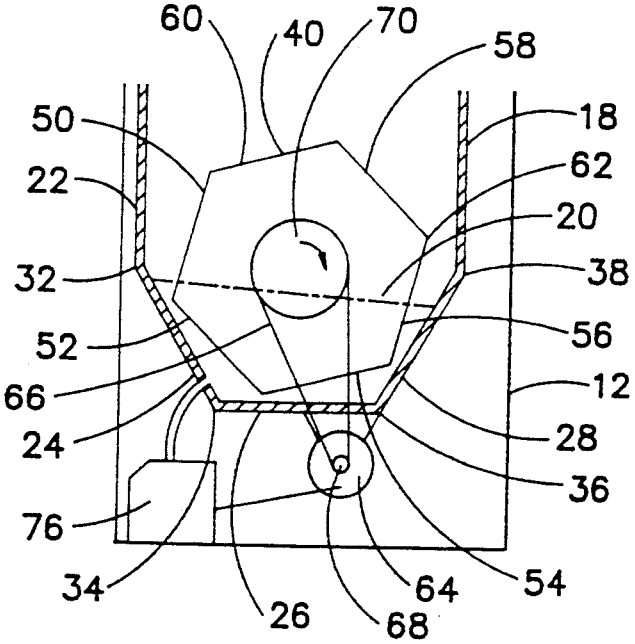
FIG. 3 is a front elevational view of the embodiment of FIG. 1 with a portion removed to reveal the inner mechanisms.
Figure 4:
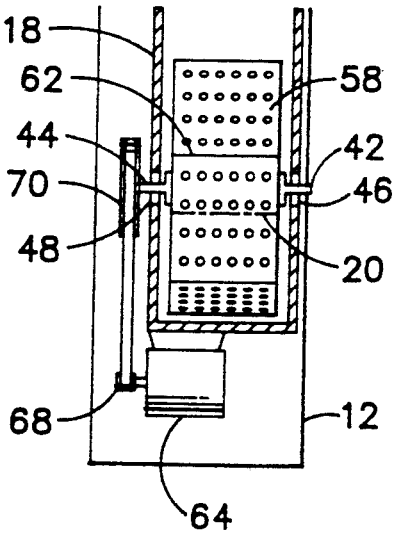
FIG. 4 is a view in side elevation of the embodiment of FIG. 1 with a portion removed to reveal the inner mechanisms.
Figure 5:
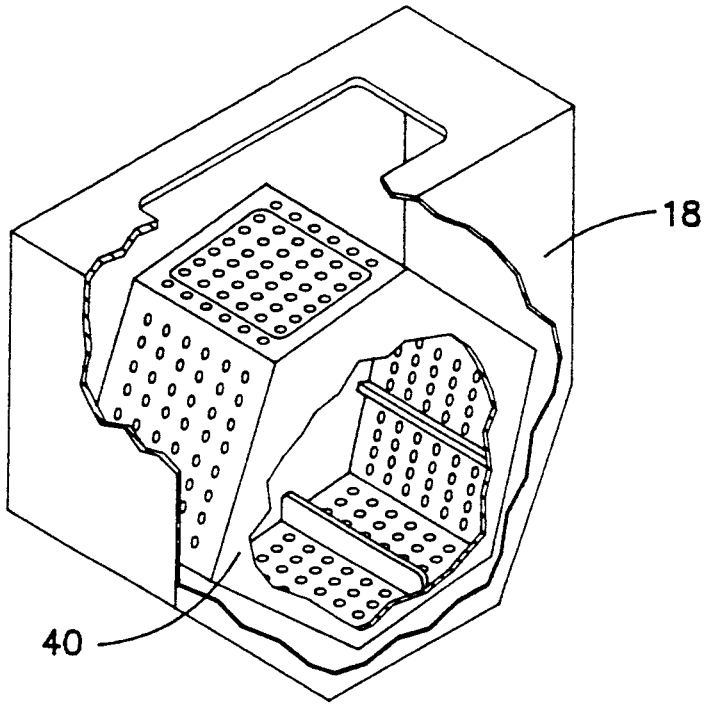
FIG. 5 is a view in perspective illustrating the outer container and inner drum portions of the preferred embodiment illustrated in FIG. 1.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

The structures of the preferred embodiment of the invention are illustrated in FIGS. 1–5. The washing machine 10 of the present invention has a cabinet 12 with a top loading, hinged lid 14 and a control panel 16. Supported within the outer cabinet 12 is an outer, relatively stationary, liquid impervious container 18. The outer container contains the washing liquid 20, the surface of which is illustrated in phantom. The outer container 18 includes a plurality of adjacent walls 22, 24, 26, 28, and 30, which intersect and are joined at interposed apexes 32, 34, 36, and 38 around at least the bottom, peripheral portion of the outer container 18. Each of the walls 22–28 is inclined to its adjoining wall. Preferably, these adjoining peripheral walls of the outer container 18 are formed as a portion of a regular polygon, most preferably an octagon. The outer stationary container 18 is supported in the conventional manner, such as by legs welded to the container, or other conventional structure which is not illustrated.

Mounted within the outer container 18 is an inner drum 40 which is rotatably mounted to the outer container 18 by means of a pair of axles 42 and 44. These axles are fixed to the drum 40 and extend outwardly through bearings 46 and 48 for rotation about a horizontal axis.

The inner drum 40 has a plurality of adjacent, perforate walls 50, 52, 54, 56, 58, and 60, which face outwardly toward the walls of the outer container 18 and intersect and join at interposed apexes, such as apex 62. Each of the peripheral walls of the inner drum 40 is inclined to its adjoining walls. Preferably, the walls of the inner drum are formed as a regular polygon and most preferably as a hexagon.

The inner drum is driven in rotation about a horizontal axis in a conventional manner. The preferred drive means is an electric motor 64 which is drivingly linked to the inner drum 40 by a drive belt 66, connected between motor pulley 68 and drum pulley 70.

The inner drum 40 is provided with conventional access doors 72 and 74 on the walls 58 and 60 of the hexagonal inner drum 40. These doors 72 and 74 are hinged to the inner drum 40 at their distally opposed ends and latched together by conventional means where they meet. The doors 72 and 74 thus permit access to the interior of the inner drum 40 for inserting and removing clothing.

The preferred embodiment is also provided with conventional liquid pumping and valving equipment 76 and with controls, both of which are well known to those skilled in the art and do not form a part of the present invention.

In operation, the present invention superimposes each of two additional hydraulic motions upon the conventional hydraulic motion of a prior art, horizontal axis, rotating washing machine and these hydraulic motions are illustrated in FIGS. 6–9.

Figure 9:
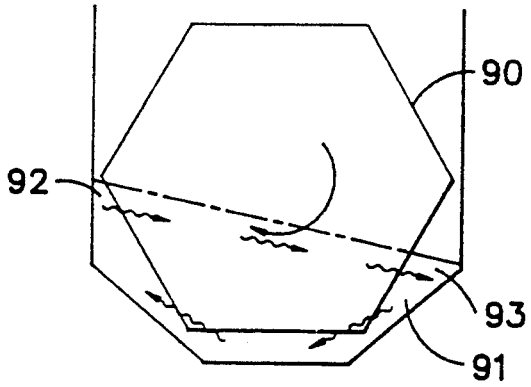

FIG. 9 illustrates the conventional hydraulic motion in a washing machine which rotates about the horizontal axis. In the conventional machine, as in Applicant's machine, the frictional engagement of the inner drum 90, with the cleaning liquid 91, drags the liquid along the peripheral outer boundary of the liquid 91, causing a higher liquid level at the side 92 where the drum periphery rises out of the cleaning liquid 91 and causing a relatively lower level at the end 93, where the periphery of the drum 90 lowers down into the liquid 91. This raised level at the end 92 causes a gravitational circulation from the end 92 down toward the end 93 and returning along the lower periphery by the motion of the drum. Consequently, there is circulation, as illustrated in FIG. 9.

Figure 6:
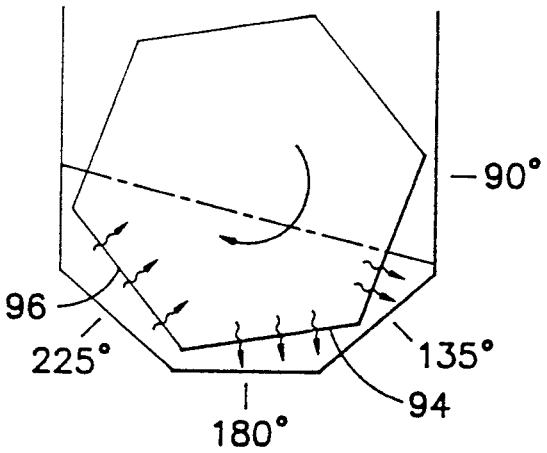
FIGS. 6–9 are diagrammatic views illustrating the operation of the preferred embodiment of the invention.
Figure 7:
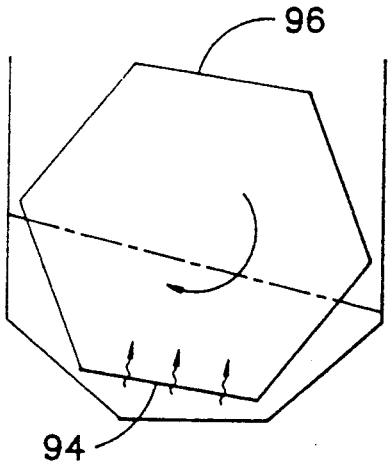
Figure 8:
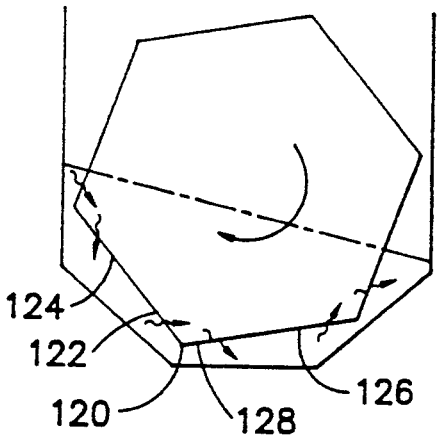

Superimposed upon this conventional gravity-friction motion of the cleaning liquid are a displacement pumping action, resulting from the present invention and illustrated in FIGS. 6 and 7, and a paddle wheel, liquid pushing action, illustrated in FIG. 8.

Referring now to FIGS. 6 and 7, the pumping action of the present invention arises because, as the drum walls pass through the liquid during drum rotation, the volume of the liquid-containing space between each peripheral drum wall and the outer container is varied. In the preferred embodiment illustrated in FIGS. 6 and 7, this interposed volume reaches a maximum when a drum wall is parallel to a wall of the outer container and reaches a minimum when the drum wall is centered inwardly of an apex between outer container walls. Thus, for example, in FIG. 6, the drum wall 94 is approaching a parallel position and consequently the interposed volume is enlarging, causing liquid to flow, as illustrated, through that wall, out of the drum. However, the wall 96 is approaching an apex and consequently the interposed volume is becoming less, causing cleaning liquid to move through the perforate wall 96 toward the interior of the drum. The liquid motion also creates substantial additional turbulence in the interposed volume thereby preventing the formation of a calm region in which cleaning agents could collect, as in prior art washing machines. As illustrated in FIG. 7, as the wall 94 passes the parallel, maximum volume position and moves toward the minimum volume position, cleaning liquid flow reverses and passes through the perforate wall 94 into the interior of the inner drum 96. This hydraulic motion is repeated for each wall of the drum as it passes through the liquid.

Figure 10:
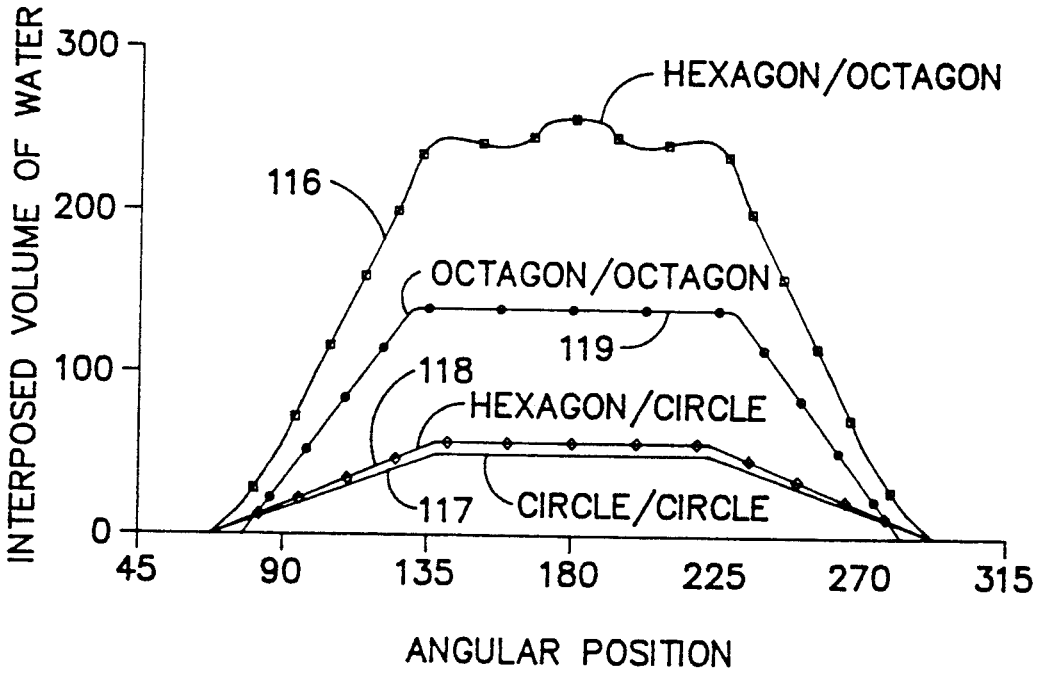
FIG. 10 is a graph illustrating the operation of the preferred embodiment of the invention and comparing it to other data.
Figure 11:
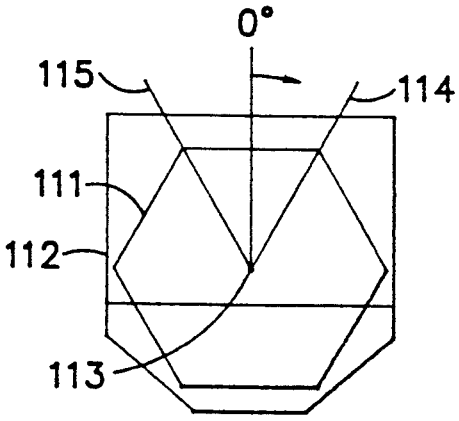
FIGS. 11–18 are diagrams illustrating the operation of the preferred embodiment of the invention, as well as other similar structures.
Figure 12:
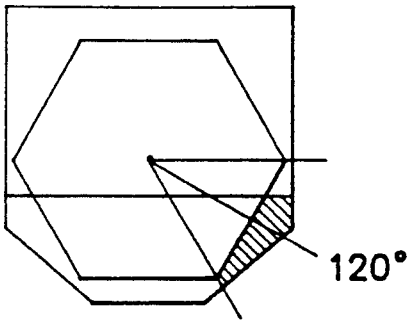
Figure 13:
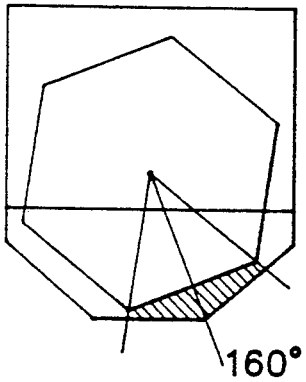
Figure 14:
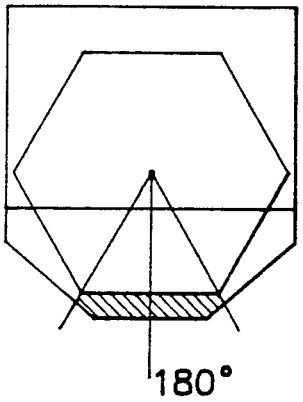

FIGS. 10–14 illustrate and graphically represent this pumping action. In FIG. 11, the hexagonal, inner drum 111, rotates within an outer container 112 about an axis 113. Each wall of the drum 111 is subtended by a 60° angle between radials 114 and 115. The interposed volume of liquid, which varies as a function of rotation of the inner drum 111, is the liquid volume between a wall of the drum, the opposite portion of the outer container wall, and the two radials 114 and 115. The volume of this liquid is shown in cross hatching in FIGS. 12–14 for rotation to positions at 120°, 160°, and 180°, with upward and vertical being defined as 0°.

Graph 116 in FIG. 10 is a plot of the liquid contained in the above defined, interposed volume, as the drum rotates from 0° through a full 360° rotation. The steep rise and fall characteristic on the outer two sides of the plot arise as the volume enters and exits the liquid, thus causing substantial changes in the cleaning liquid volume contained within the defined space between the radials and walls. This steep rise and fall is a conventional characteristic not only of Applicant's invention, but also of the prior art front loading washer illustrated by graph 117.

Figure 15:
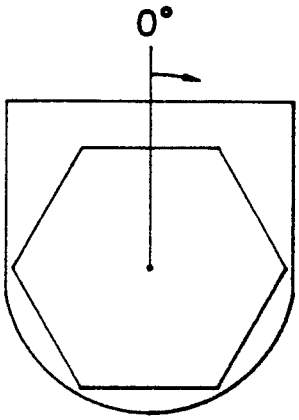
Figure 16:
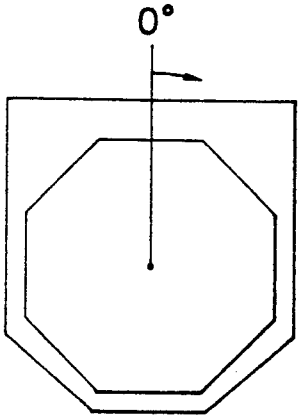

The unique hydrodynamic pumping action of Applicant's invention is represented by the oscillating wave-like crests between approximately 140° and 230°. This periodic variation of the volume interposed between the inner drum and the outer container arises, if regular polygonal shapes are used, only when the regular polygons have a differing number of sides. The wave-like action does not occur if either the inner or outer container has only a circularly formed wall, such as the shape illustrated in FIG. 15 and plotted in FIG. 10 as graph 118 and a double circle shape plotted as graph 117. Similarly, the hydrodynamic pumping action of the present invention does not occur with two regular polygons with the same number of sides, as illustrated for two octagons in FIG. 16, and plotted in FIG. 10 as graph 119.

Figure 19:
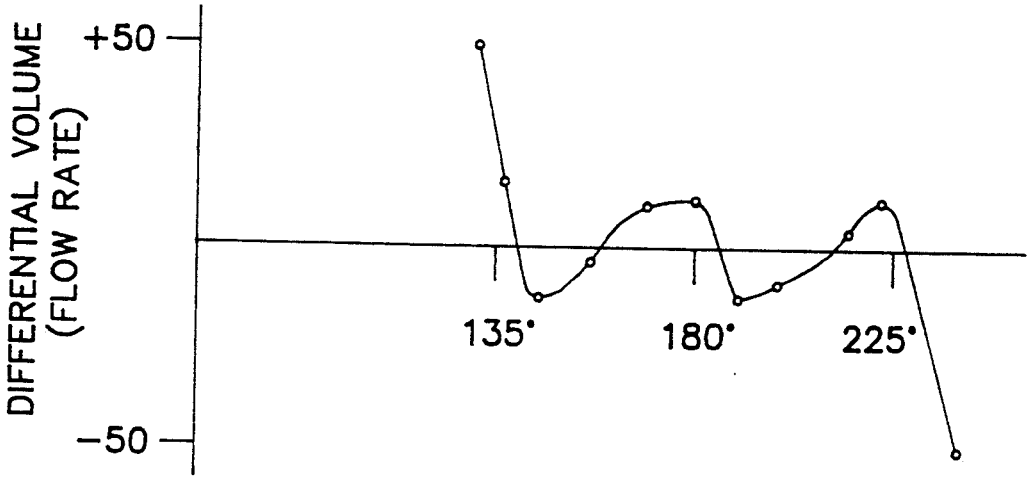
FIG. 19 is a graphical illustration of the differential volume variations and thus the flow rate accomplished by the preferred embodiment of the invention.

FIG. 19 illustrates a plot of the differential volume between angular data points, illustrated in FIG. 10. Thus, it is a plot of the difference between the volume at the previous angular position and the volume at the 10° subsequent angular position, thus representing the differential of the volume, which is the flow rate. Consequently, FIG. 19 illustrates variations in flow rate or flow velocity, arising because of the displacement pumping action of the present invention.

While it is believed that identical, concentric, regular shapes will not produce the hydraulic pumping action illustrated in plot 116 of FIG. 10, it will be apparent to those skilled in the art that various modifications can be made based upon the principles of the present invention. For example, irregular polygons might be utilized to obtain the operation in accordance with the present invention, by having the angles subtended by the walls of the inner drum different than the angles subtended by the walls of the outer container so that some hydraulic, periodic pumping action can be accomplished with such an irregular polygon.

It will further be apparent to those skilled in the art that it is not necessary that each side be planar. The sides of either or both the drum and the outer container may be curved or domed and directed either convexly or concavely.

It will also be apparent that, although it is preferred to form the alternately inclined walls of both the inner drum and the outer container around the outer periphery of each, it would also be possible to form the adjacent intersecting walls, which are inclined to each other, around one or both of the end walls which extend generally radially of the axis of rotation.

Because the interposed volumes adjacent to adjoining walls are commonly undergoing oppositely directed volume changes, some leakage in a circular direction around the apexes is experienced. Thus, while a substantial portion of the liquid which is moved as a result of the volume change passes through the perforations in the drum walls, some passes sidewards around an apex to the adjoining, interposed volume. This apical leakage can be reduced or minimized by minimizing the clearance distance between the apexes of the inner drum and the central region of each wall of the outer container. For home washing machine use, it is preferable to form both the outer container and the inner drum from a regular polygon which has a width substantially in the range of 20 inches to 24 inches and to provide approximately a one-half inch clearance distance between the two.

The speed of rotation of the inner drum is selected essentially in accordance with conventional, prior art principles. Drum speed is selected so that the garments will be raised to approximately the top-most position during rotation and fall downwardly into the cleaning liquid. As drum speed increases, the garments are raised higher because centrifugal force is increased. Similarly, as drum radius is increased, the centrifugal force is increased and consequently the garments are raised higher. For the preferred embodiment, having the preferred dimensions described above, a speed of approximately 40 revolutions per minute is desirable.

It has also been found desirable to follow the stop and reverse practice which is conventional for horizontal, rotating washing machines. The drum is drivingly rotated in one direction for a first time period and then alternately driven in the opposite direction for an equal time period, alternating many times during the washing cycle. This is done in the conventional manner and therefore is not described more fully.

In addition to the conventional gravity-friction circulation component of hydraulic action and the displacement pumping hydraulic activity component of the present invention, the present invention also creates and superimposes upon the other two, a third hydraulic action which might be termed a paddle wheel action. The outer periphery of the inner drum, illustrated in FIGS. 8 and 9, for example, can be described as formed by a surface which extends alternately more and less radial distance from the center as one travels about the circumference of the regular polygon. Thus, the drum may be described as having a plurality of relatively protruding perforate lobes, each centered at an apex. These perforate lobes operate as liquid pushing paddles.

Referring to FIG. 8, it can be seen that the drum apex 120 can be viewed as the center of a lobe having a leading surface 122, which consists of the half of drum wall 124 adjoining apex 120. Similarly, the one-half of drum wall 126 which is adjacent to apex 120, provides a trailing surface of the lobe-like paddle. Because the walls are perforated and are pushed through the cleaning liquid and encounter fluid resistance, a relatively higher liquid pressure is created on the leading surface, such as leading surface 122, and a relatively lower liquid pressure is created on the lagging surface, such as lagging surface 128. This pressure differential causes an additional component of hydraulic action in the form of an inflow through the leading surface into the drum and an outflow through the lagging surface from the interior of the drum, as illustrated in FIG. 8. This additional component of liquid motion is superimposed upon the previously described other two components. The lobes also, in acting like paddles, contribute to the turbulence in the interposed volume to assist in mixing of the cleaning agents.

Figure 17:
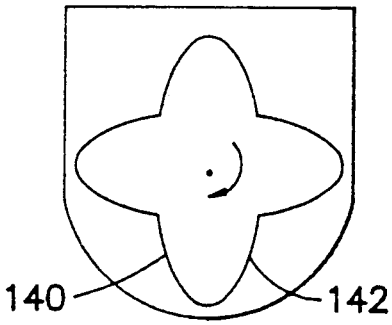

FIG. 17 illustrates that the paddle wheel component of liquid flow can be obtained in the absence of an embodiment which obtains the hydraulic pumping component of the present invention. FIG. 17 illustrates an embodiment having four lobes, each having a leading perforate wall, such as wall 140, and a lagging perforate wall, such as wall 142.

Figure 18:
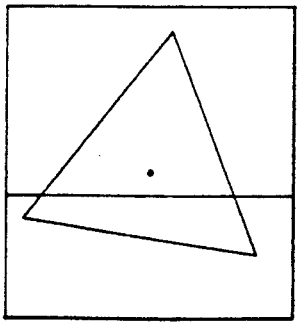

FIG. 18 illustrates that regular polygons having fewer walls may be utilized to accomplish the pumping hydraulic action of the present invention, other than six and eight sided regular polygons. Not only could five and seven sided regular polygons be utilized, but others such as a rectangular and regular triangle theoretically can be used. The problem becomes one of making counterbalancing, engineering trade-offs. The fewer the number of sides, the more pronounced the hydraulic action becomes. However, as the number of sides become fewer, the clothing capacity of the inner drum becomes less and the space is less efficiently occupied by the machine. On the other hand, the greater the number of sides, the more nearly a circular configuration is approached, which, of course, accomplishes no hydraulic action. Thus, it can be seen that pumping displacement diminishes as more sides are used.

Consequently, not only does the present invention provide a washing machine which has all the water and soap saving advantages of conventional, horizontal axis, rotating washing machines, but provides additional advantages because of the additional components of liquid action described above. The additional liquid action provides improved initial mixing of the cleaning agents when first introduced into the machine and maintains a uniformly homogeneous mixture. The additional hydraulic components of action also provide additional, gentle mechanical action upon the clothing, which improves the cleaning activity. Consequently, even less cleaning materials and liquid are necessary. Similarly, even less liquid is needed for rinsing action because the improved liquid motion and hydraulic action works the clothes more mechanically to remove soap.

While certain preferred embodiments of the present invention have been disclosed in detail, it is to be understood that various modifications may be adopted without departing from the spirit of the invention or scope of the following claims.

I claim:

1. A washing machine comprising:

(a) an outer, relatively stationary, liquid impervious container for containing a washing liquid, the outer container including a plurality of adjacent walls intersecting and joined at interposed apexes around at least its bottom portion forming a portion of a regular polygon having at least six sides, each wall being inclined to its adjoining walls;

(b) an inner drum having perforate peripheral walls and mounted within the outer container for rotation about a substantially horizontal axis, the inner drum being formed with a plurality of at least five adjacent walls facing the walls of the outer container and intersecting and joined at interposed apexes forming a regular polygon having a number of sides different from the number of sides of said regular polygon which defines the outer container, each wall being inclined to its adjoining walls at a different angle than the angle between the walls of the outer container; and (c) drive means drivingly linked to the inner drum for rotating the inner drum about an axis of rotation;

whereby rotation of the inner drum relative to the outer container varies the adjacent liquid volume between each drum wall and the outer container as the drum walls pass through the liquid.

2. A washing machine in accordance with claim 1 wherein said walls are formed on the periphery of the drum and the periphery of the container generally parallel to said axis of rotation.

3. A washing machine in accordance with claim 2 wherein the regular polygon of the drum is a hexagon and the regular polygon of the outer container is an octagon.

4. A washing machine in accordance with claim 3 wherein the widths of the regular polygons of the inner drum and of the outer container are substantially within the range of 20" to 24", wherein there is approximately a one-half inch clearance distance between them and wherein the drive means drives the inner drum at approximately 40 r.p.m.

* * * * *